US005263260A

United States Patent [19]

Smith

[11] Patent Number: 5,263,260

[45] Date of Patent: Nov. 23, 1993

[54] TILE LEVELER AND METHOD

[76] Inventor: Lee R. Smith, 178 Citrus Tree La., Longwood, Fla. 32750

[21] Appl. No.: 923,564

[22] Filed: Aug. 3, 1992

[51] Int. Cl.[5] ..... G01B 1/00

[52] U.S. Cl. ..... 33/526; 33/518; 33/371; 33/DIG. 20

[58] Field of Search ..... 33/518, 526, 527, 370, 33/371, 376, 411, 809, DIG. 20

[56] References Cited

U.S. PATENT DOCUMENTS

| | | | |
|---|---|---|---|
| 1,941,404 | 12/1933 | Lansing | 33/518 |
| 2,130,743 | 9/1938 | Parsons | 33/518 |
| 2,642,667 | 6/1953 | Smiley | 33/809 |
| 2,752,691 | 7/1956 | Bender | 33/518 |
| 3,161,964 | 12/1964 | Myles | 33/376 |
| 3,328,887 | 7/1967 | Wright | 33/809 |
| 3,368,286 | 2/1968 | Zenke | 33/518 |
| 3,744,141 | 7/1973 | Strickland, Sr. | 33/526 |
| 4,429,466 | 2/1984 | Leonard | 33/371 |
| 4,782,597 | 11/1988 | Mills | 33/370 |
| 4,813,149 | 3/1989 | Herkimer | 33/462 |

FOREIGN PATENT DOCUMENTS

| | | | |
|---|---|---|---|
| 2121286 | 11/1972 | Fed. Rep. of Germany | 33/526 |
| 0086585 | 10/1957 | Netherlands | 33/526 |

*Primary Examiner*—Thomas B. Will

*Attorney, Agent, or Firm*—Allen, Dyer, Doppelt, Franjola & Milbrath

[57] ABSTRACT

A device and method for facilitating the installation of fascia materials such as tile on bathtub walls, fireplace facings and feature walls includes a support member with arms that extend so as to fit between facing side walls and be self supporting. The support member contains spring loaded arms that are activated by the push of a button and are locked into position against the side walls. Side bar members are attached to the support member and leveled for installation of tile on the facing walls of a bathtub or shower stall. The support member and side bar members have spirit levels attached for an accurate and quick leveling adjustment. Fascia material designs such as tile patterns are centered by the use of calibrated scales on the arms activated to extend and lock against the side walls. By attaching a second support member to the support member, the device is configured for use in setting fireplace facing tiles. The device geometry and specifications are configured to be used with fascia materials such as ceramic tile but it is appropriate for other wall installations requiring leveling of patterned designs. The device accommodates the use of long setting cements and adhesives that permit cost effective installations.

27 Claims, 3 Drawing Sheets

FIG. 9
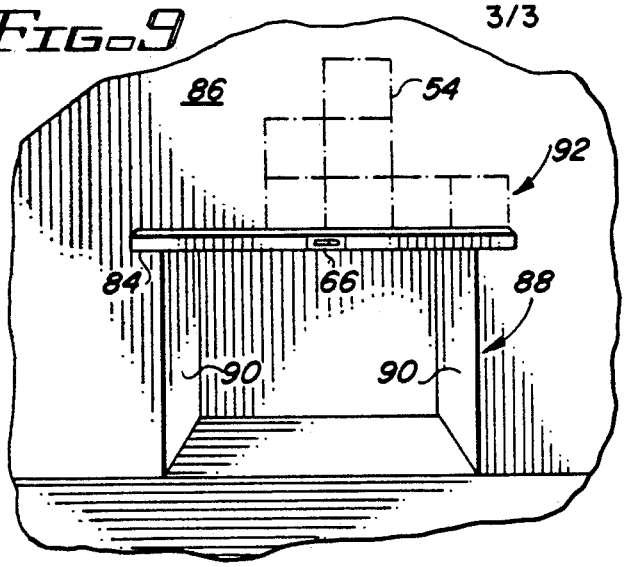
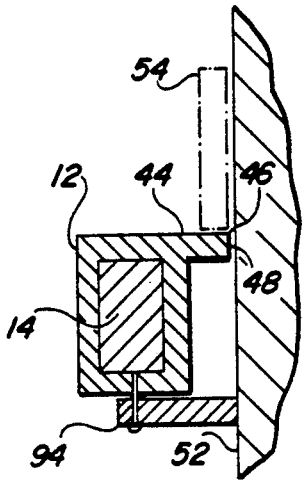
FIG. 13
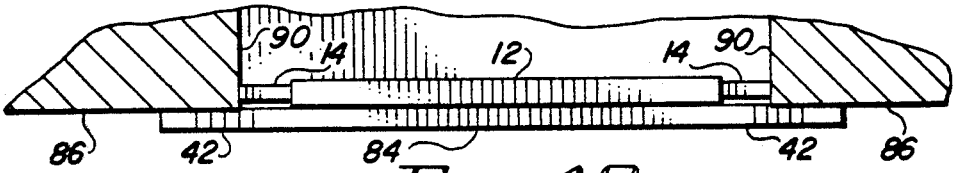
FIG. 10
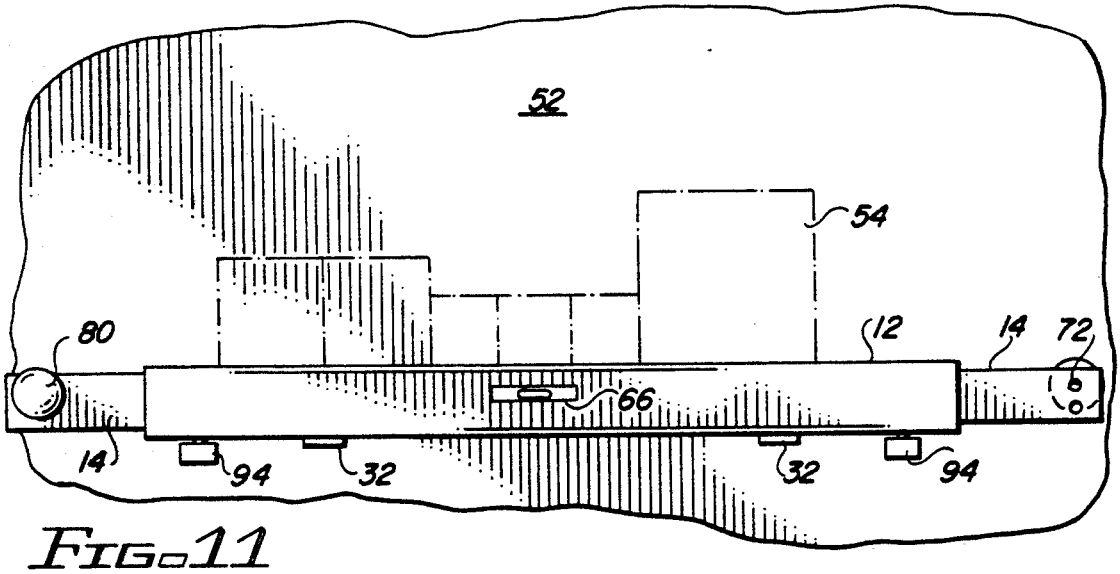
FIG. 11
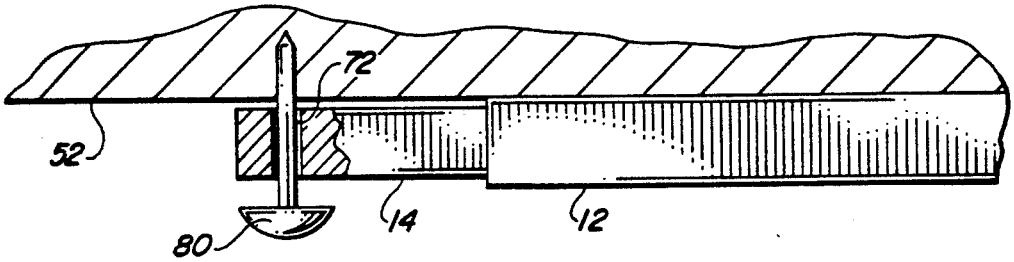
FIG. 12

TILE LEVELER AND METHOD

BACKGROUND OF THE INVENTION

1. Field of the Invention

The present invention relates to the installation of fascia materials such as wall tile, and to a novel device for aligning and centering the fascia material. In particular, the invention is directed to a device that will permit a tile setter to position the first row of fascia material such as wall tile in a desired pattern and continue to set the desired pattern using long setting cements. The device is used primarily for the installation of wall tile in bathtub and shower stalls as well as facing fireplace walls. The device facilitates the installation of fascia materials for various feature wall installations.

2. Prior Art

The requirements to properly perform in the installation of wall tile include the need for the proper layout of the fascia material pattern and the proper alignment of the starting rows of that pattern. Typically in a bathtub setting, the tile setter starts with the wall facing outward. This is usually the wall along the back side of the tub. The tile setter checks to see if the surface to be covered is level. He will check to see if the tub itself is level. Usually it is not and means of establishing a level horizontal line is necessary before the first row of tile can be started. In the case of a shower, the floor being covered will be checked. If floor tile is to be installed, it is important to establish the proper location of the first row of tile so that proper slope to the drain is maintained. Typically, tubs and showers installed by the plumber are set directly on the floor with little attention to establishing a level surface for reference in setting the tile. Most tubs are not level. The installer will usually set two of the tile to be set on a tub ledge, place his level on the tops of the tile to establish the proper spacing to the tub ledge ad then raise one end of the level to establish the line for the initial row of tile to be set. With a line drawn, he can begin to set the tile. If a tile pattern is to be centered with respect to the side walls, additional measurements are made. In some cases the tile setter will nail a board to the wall to aid in the installation. Extreme care is needed in setting the initial row of tile. If uneven or not level, the error is increased as the added rows of tile are set up the wall and obvious defects in the installation are seen as unacceptable. If the wall tile is set level and centered for the initial row, the remaining tile will run true for the joint spacing requiring grout. If not, the tile will drift and at some point, retiling will be necessary causing costly loss of time. The procedures for installing fascia material on a facing fireplace wall are much the same and require the same diligence in establishing a properly aligned and centered pattern for the material being affixed to the wall.

Further, there are basically two bonding materials (adhesives and thin bed cements) used for adhering the fascia materials to walls. The use of long setting bonding materials such as thin bed cement are preferred. With long setting bonding materials, the tile setter has more time to work and can prepare more surface area before setting the tile. As in the preparation for the initial row, the amount of preparation for the wall to be covered is important in establishing time spent on an installation project and ultimately to the cost of that project. A job well done, although qualitative and somewhat immeasurable, will result in the future business needed to prosper.

U.S. Pat. No. 3,744,141 issued Jul. 10, 1973 (Strickland, Sr.) discloses a support device for supporting tile elements and for aligning the tile elements relative to a predetermined horizontal level line in the initiation of a tile setting operation. The support device includes a first tile supporting bar having adjustable means for changing the effective length of the first tile supporting bar. The device includes elongated tile supporting bars extending at right angles from opposite ends of a first tile supporting bar with the dimensions of the elongated tile supporting bars detailed to extend around the upper surface of and adjacent three lateral edges of a bathtub. A number of adjustable elements are operatively connected to the tile supporting bars whereby the supporting bars can be angularly oriented relative to a predetermined horizontal level line.

U.S. Pat. No. 1,941,404 issued Dec. 26, 1933 (Lansing et al) discloses a tile setting machine that relates to the setting of floor and wall tile whereby tile may be set more rapidly and more accurately than done by hand or by prior machines. The tile setting machine has as its objective to aid in the rapid aligning of the tile and to provide means for insuring that the tiers of tile shall be horizontal when placed in position on the wall.

U.S. Pat. No. 4,813,149 issued Mar. 21, 1989 (Herkimer) discloses a level device having an extendible body portion with a pair of pivotal mounted extendible swingers. A spirit level is provided on each of the swingers to allow the body portion to be held in a horizontal level position. The device is useful for hanging pictures on walls, locating shelves, drawing designs on walls and in measuring operations.

SUMMARY OF INVENTION

The tasks of the typical tile setter discussed above are made possible and facilitated by the present invention which includes a support member with means for affixing to a wall and for supporting, aligning and centering the fascia material with the support member. The support member includes means for extending and affixing to side walls such as are present in a bathtub and shower stall. An important feature of the invention is the means for affixing the support to the side walls through the use of arms that extend from the support member and bias against the side walls using compression springs located inside of the support member. The arms include matching calibration scales to permit the centering of the support member and the fascia material that will be supported by the support member during installation.

Another feature of the invention is the provision for affixing side bar members to the support member and affixing the side bar members to the side wall for facilitating in the installation of the fascia material required for the side walls. Fascia material is aligned using side bar members having means for aligning with the fascia material and for affixing to the support member and affixing to the side walls. Walls with spigot pipe protruding is accommodated by the side bar member design which has a contour cut out of the side bar member corresponding to the typical location of the spigot wall pipe. The spigot pipe typically extends from the side wall of a bathtub at the same height above the bathtub shelf as the top of the first row of tile.

By the addition of a second support member to the first support member, the installation of fascia material to a fireplace facing wall is facilitated. The second support member can be aligned and centered and supports the initial row of fascia material being installed.

The primary objective of the present invention is to provide a means for affixing a support for the initial row of fascia material by means of a support member that extends and affixes to the side surfaces. In a bathtub or shower stall setting, the side surfaces are most often side walls. This objective extends to a fireplace facing wall by extending the arms of the support member and biasing them against the fireplace box side walls.

Another objective is to facilitate the installation of the fascia material by means of centering the support so as to center the pattern featured on the wall. This is the case for bathtub, shower stall and fireplace facing walls as well as a feature walls in general such as those fascia material used in mural designs.

Aligning the fascia material for the facing walls as well as the side walls completes the desired means for facilitating an installation. Side bar members have means for affixing to the support bar member arms and to the wall providing the support needed for the installation of the side wall tiles.

The synergistic result is a method for the tile setter that provides a systematic installation procedure while at the same time providing the support for the fascia material that tolerates the use of long set time bonding materials.

BRIEF DESCRIPTION OF DRAWINGS

FIG. 9 is a perspective view of a facing fireplace wall and fireplace box illustrating the manner in which the device configured with its second support member is used for facilitating the installation of fascia material on a facing fireplace wall.

FIG. 10 is a top view of the device support member affixed to the fireplace box configured with the second support member.

FIG. 11 is a front view of the device used with push pins to affix the device to a facing wall.

FIG. 12 is a partial top view showing the push pin passing through the tension pin hole and penetrating the wall.

FIG. 13 is a cross-sectional side view of the support member with a shim tab in position to keep the top flat surface and edge in a perpendicular position along the facing wall for a secure contact with the tile.

DETAILED DESCRIPTION OF PREFERRED EMBODIMENT

Figure 1:
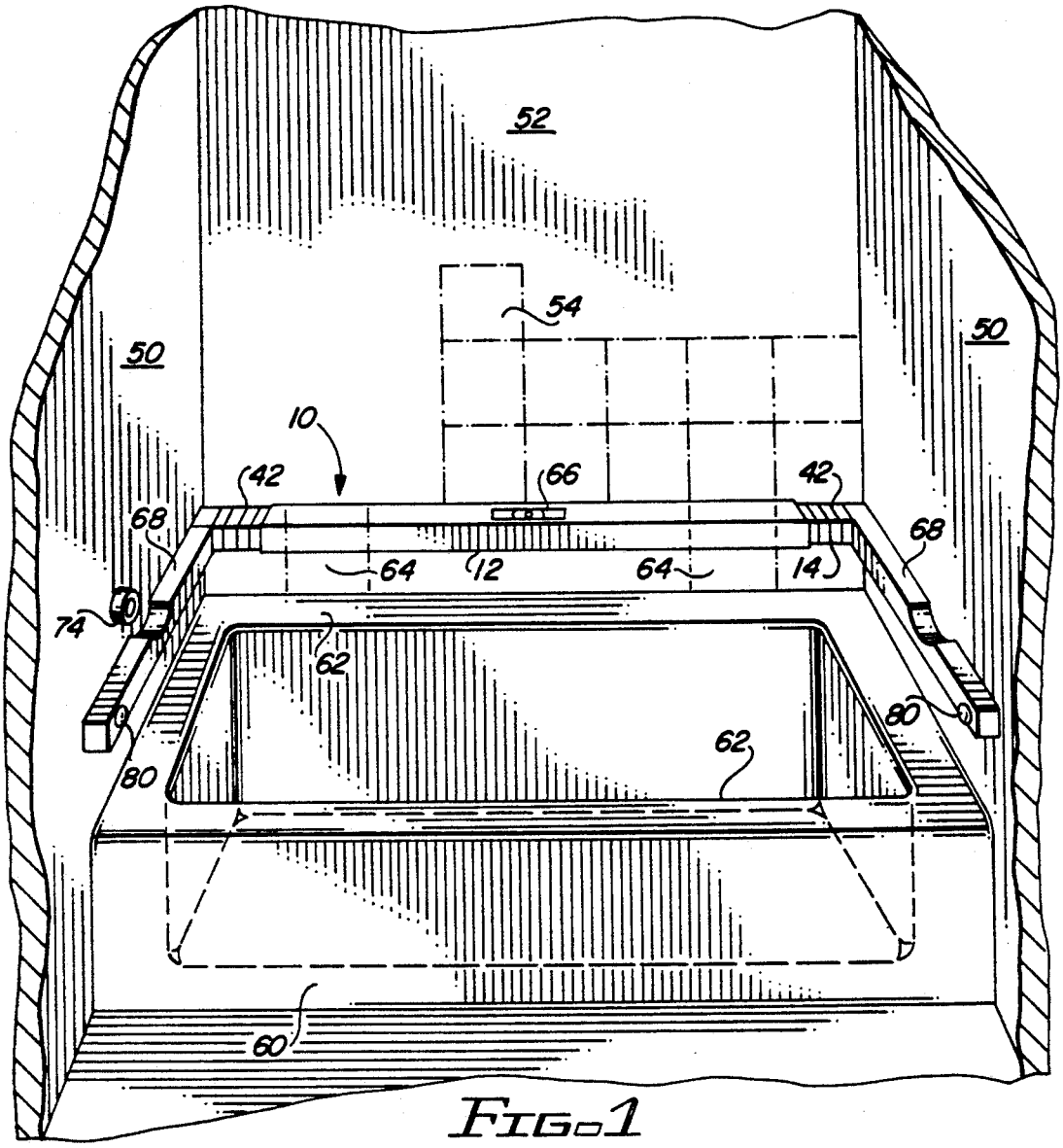
FIG. 1 is a perspective view illustrating the manner in which the device is used for facilitating the installation of fascia material such as wall tile in a bathtub setting.

A detailed description of a preferred embodiment can be seen by referring to FIG. 1 of the attached drawings. Reference numeral 10 refers to the device configured for facilitating the installation of fascia material such as wall tile 54 in a bathtub 60 setting.

Figure 2:
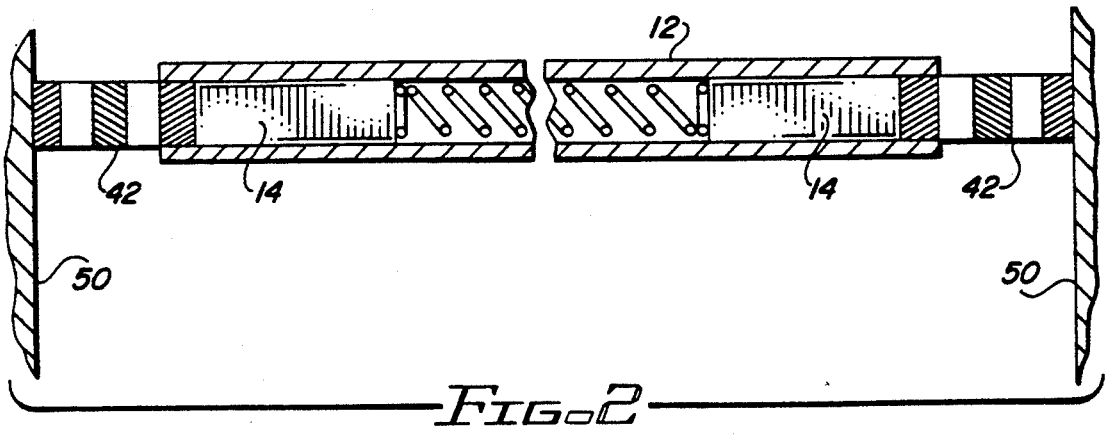
FIG. 2 is a partial cross-sectional view of the support member illustrating the manner in which the arms are biased against side walls and how the support member is centered using calibration scales located on the arms.
Figure 3:
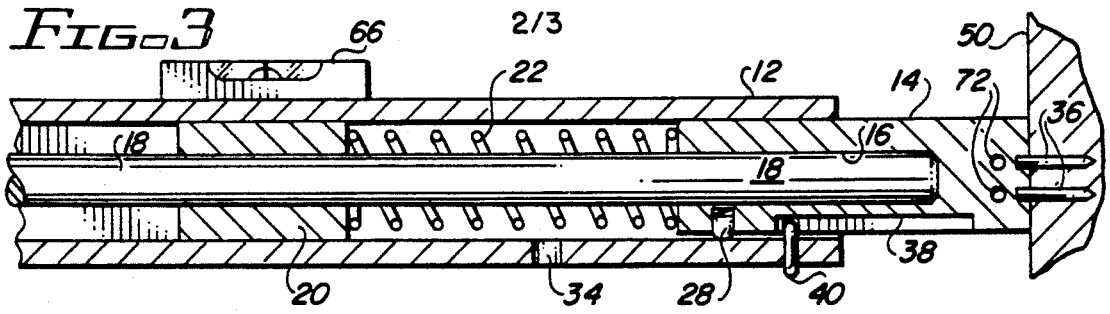
FIG. 3 and FIG. 4 are partial cross-sectional views of the support member showing an arm in an extended and retracted position respectively using the compression spring and holding block.
Figure 4:
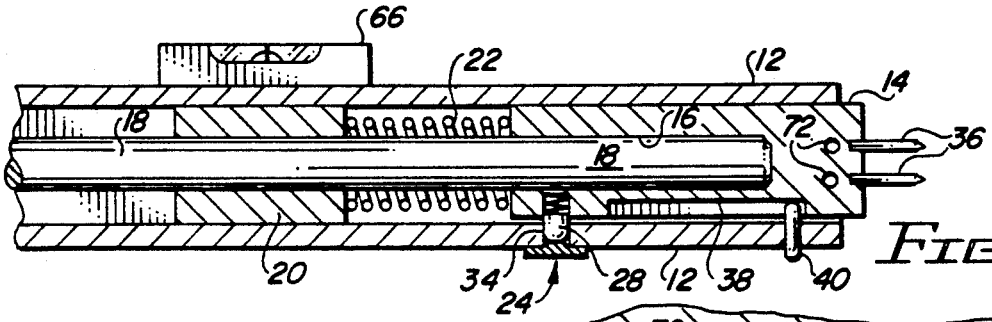
Figure 5:
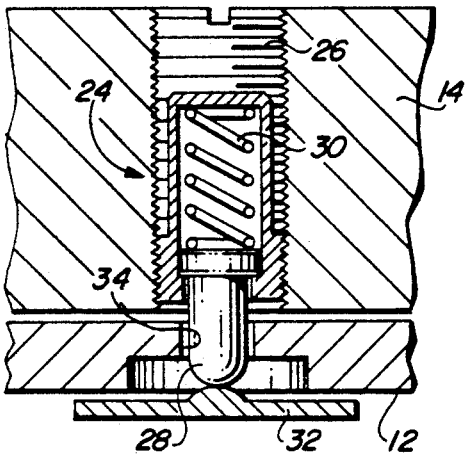
FIG. 5 is a detail cross-sectional view of the push button mechanism used to lock and release the arms.

The device includes an elongated support member 12 whose length is less than the distance between the side walls 50. The support member 12 is hollow and has a first end and a second end. At each end of the support member 12, an elongated arm 14 having an outside dimension less than the inside dimension of the support member 12 is fitted and telescopes into and out of the ends of the support member 12. FIG. 2 is a partial cross-sectional view showing the arms 14 located at each of the first and second ends of the support member 12. The arm 14 telescopes into and out of the support member 12 using a dowel 18 that fits within a coaxial hole 16 cut into the center and along the length of the arm 14. The dowel 18 runs through and is fixed to a holding block 20. A compression spring 22 is biased against the holding block 20 and the first end of the arm 14 located inside the support member 12. The dowel 18 is coaxial to the compression spring 22 and keeps the compression spring 22 in an aligned position between the holding block 20 and the arm 14. The arm 14 contains a slot 38 located along the length and on one side of the arm 14. The length of the slot 38 is less than the length of the arm 14. A stop 40 extending into the slot 38 is affixed to the support member 12 and slides from a first end of the slot 38 to a second end of the slot 38 thus limiting the distance that the arm 14 can telescope. The stop 40 is a safety feature preventing the arm 14 from being released outside of and beyond the support member 12. The arm 14 also includes a push button mechanism 24 that permits the arm 14 to be latched in a position against the compression spring 22 with the compression spring 22 in a fully compressed configuration. FIG. 3 and FIG. 4 include cross-sectional views of the arm 14 in relation to the compression spring 22, dowel 18 and holding block 20. FIG. 3 shows the arm 14 in the extended position with the slot 38 against the stop 40 limiting the travel of the arm 14. FIG. 4 is the same cross-sectional view showing the compression spring 22 in the compressed configuration. When the arm 14 is biased against the compression spring 22 to force the compression spring 22 into its compressed configuration, the arm 14 is held in this compressed configuration by a push pin 28 extending into a push pin hole 34 located in the support member 12. The push pin 28 is located in the push button mechanism 24 that is affixed to the arm 14. FIG. 5 includes a cross-sectional view of the push button mechanism 24. The push pin 28 is housed in a threaded casing 26 that is screwed into the arm 14. The threaded casing 26 contains the push pin 28 that extends outside one end of the threaded casing 26 and into a push pin hole 34 located in the wall of the support member 12. The push pin is always biased outward from the casing 26 by a push pin spring 30. The first end of the push pin spring 26 is biased against the push pin 28 and the second end of the push pin spring 26 is biased against the casing 26. In the compressed configuration of the compression spring 22, the push pin 28 extends into the push pin hole 34 of the support member 12 and locks the arm 14 into position. The support member 12 has a push button 32 affixed over the push pin hole 34. By pressing in on the push button 32, the push pin 28 is depressed and released from the push pin hole 34. The compression spring 12 expands and causes the arm 14 to extend outside of the support member 12 causing an expanded length to the support member 12. The first end and the second end of the support member 12 contain similar arm 14 mechanisms. The expanding arms 14 bias against the side walls 50 holding the support member 12 into position. For additional support and firmness of grip, wire pins 36 are permanently affixed to the second ends of the arms 14. The wire pins 36 provide additional support as they affix into the side walls 50.

Figure 6:
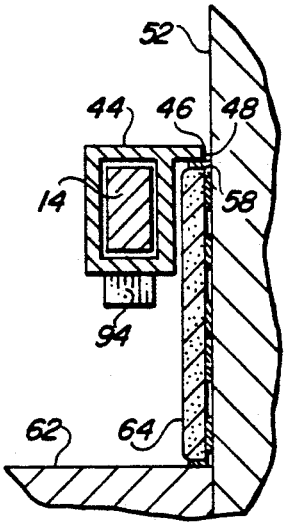
FIG. 6 is a cross-sectional side view of the support member showing an edge in relation to a fascia material such as a wall tile.

In a typical installation of wall tile on the facing wall 52 over a bathtub 60, two initial wall tile pieces 64 are first cemented onto the facing wall 52 while resting directly on the bathtub top surface 62. FIG. 6 is a cross-sectional side view showing the lip 48 along the extended edge 46 of the top flat surface 44 of the support member 12 resting on the initial wall tile 64 which tile is resting on the bathtub top surface 62 and cemented to facing wall 52. One of the wall tile pieces 54 is placed near the first end of the support member 12 and the other wall tile piece 54 is placed at the second end of the support member 12. The support member has a top flat surface 44 with an edge 46 that extends beyond the other surfaces to create a lip 48 on the top the support member 12. The edge 46 of the support member 12 is placed on tile edge 58 of the two wall tile pieces 54 cemented to the facing wall 52 and resting on the bathtub top surface 62. A spirit level 66 is fixed to the support member 12. By keeping the first end of the support member 12 on its corresponding wall tile piece $4 and lifting the second end of the support member 12, a position is selected such that the spirit level 66 indicates a level horizontal position.

Figure 7:
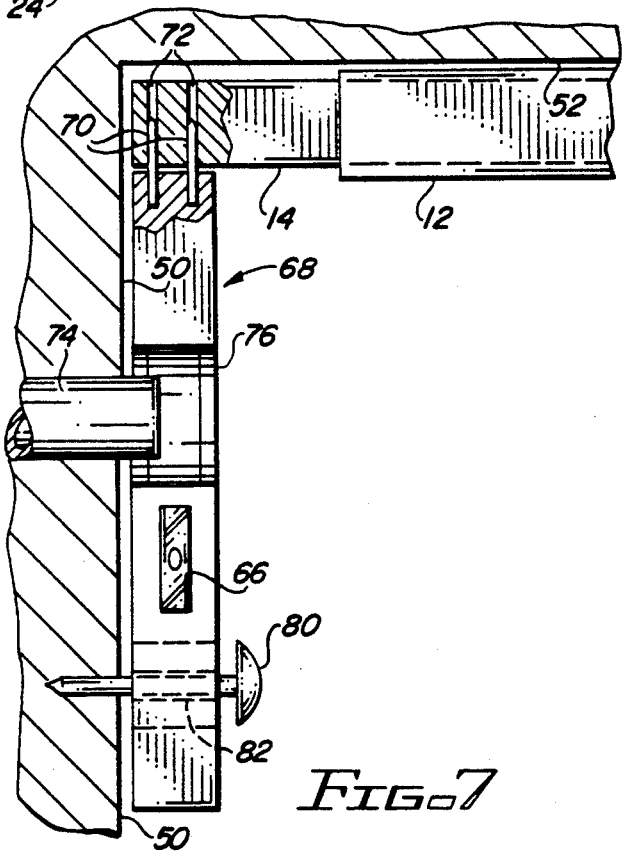
FIG. 7 is a partial top view of the device shown with the side bar member attached to the arm of the support member and the set pin penetrating the side bar member affixing the side bar member to a side wall.

The embodiment shown in FIG. 1 also includes the use of side bar members 68 affixed to the arms 14 of the support member 12. The side bar member is elongated with a first end and second end. The first end has tension pins 70 that penetrate into tension pin holes 72 located in the arms 14 and affix to the arms 14. A set pin 80 penetrates the side bar member 68 through a set pin hole 82 located at the second end of the side bar member 68 and affixes to the side wall 50. It is anticipated that those skilled in the art will install additional set pins 80 and set pin holes 82 to provide more support for those cases where it is warranted by the type of fascia material and wall material used in the construction. FIG. 7 is a partial top view of the device 10 shown with the details of the side bar member 68.

In many installations, there is a need to center a fascia material pattern on the facing wall 52. The arms 14 have been inscribed with calibration scales 42. The scale 42 is such to allow the first and second ends of the support member 12 to be lined up with a matching indicator on the scale 42. In this way, the support member 12 is centered on the facing wall 52. In the preferred embodiment, the spirit level 66 is used as a center mark on the support member 12. It is anticipated that other marks can be affixed for centering and laying out various wall patterns. FIG. 2 shows one example of the calibration scales that are used.

In the typical installation of FIG. 1 requiring the use of the side bars 68, the side bar 68 is first attached to the arm 14 by inserting the tension pins 70 into the tension pin holes 72 of the arms 14. By using the spirit level 66 affixed to the side bar member 68, a level horizontal position is selected and the push pin 80 is pushed through the push pin hole 82 in the second end of the side bar 68 and into the side wall 50.

Figure 8:
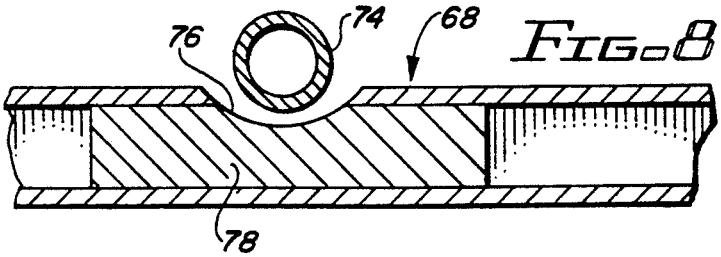
FIG. 8 is a partial cross-sectional view showing the side bar member used in the presence of a spigot pipe.

In many cases involving the typical bathtub setup, a water spigot pipe 74 protrudes from one side wall 50 at such a location to interfere with the first row of tile to be installed. The side bar member 68 has been designed to accommodate this situation and includes a contour 76 in the proximate center area of the side bar member 68. The contour 76 is accomplished by cutting through the side bar member 68. To provide additional strength in the side bar 68 at the contour, filler material 78 is added inside the hollow side bar in the immediate area of the contour 76. FIG. 8 is a partial cross-sectional view shoeing the spigot pipe 74 in relation to the contour 76 located in the side bar member 68.

The device 10 can be adapted when used in facilitating the installation of fascia material such as wall tile on a fireplace facing wall 86. FIG. 9 is a perspective view of a facing fireplace wall 86 and fireplace box 88 with the device 10 configured for such installations. An elongated second support member 84 is affixed to the support member 12 along their corresponding sides. The length on the support member 12 is such that it is smaller than the horizontal opening in a fireplace box 88. As is the case for extending the arms 14 in the first embodiment, the arms 14 are biased against the side walls 90 of the fireplace box. A spirit level 66 is affixed to the second support member 84. In a typical installation, the second support member 84 is held against the fireplace facing wall 86 allowing the support member 12 to rest inside the fireplace box 88 opening. Once a level horizontal position is established, the arms 14 are released from the compressed position as in the first embodiment. The arms 14 extend and bias against the fireplace box side walls 90 affixing both the support member 12 and the second support member 84 into position for setting the initial rows of tile 92 on the fireplace facing wall. FIG. 10 is a top view of the device configured with the support member 12 and the second support member 84 affixed to the fireplace box 88.

As is the case in the installation of bathtub wall patterns, the tile installer of the fireplace facing wall 86 is faced with the need to center the pattern of the fascia material being installed. Calibration scales 42 are affixed to the second support member 84 near the first and second ends of the second support member 84 and in such way so as to overlap the fireplace box side walls 90. As with the matching scales on the arms 14, similar scale markings are lined up in this case with the side walls 90 of the fireplace box 88. The spirit level 66 is located in the center of the second support member 84 and used as the centering mark. It is anticipated that one skilled in the art will place additional marks on the second support member 84 as a guide in the installation of various fascia material patterns.

Another anticipated use of the device includes using push pins 80 passing through the tension pin holes 72 of extended arms 14 and into the facing wall 52 for affixing the support member 12 to the facing wall 52. This use (FIG. 11) without need for side walls 50 (FIG. 1) facilitates the installation of fascia material such as ceramic chair railing, wood molding, and accent striping by using the push pins 80 to affix the support member 12 and spirit level 66 as a leveling guide.

In the way of example, if a ceramic chair rail was to be installed, a height above a floor on the wall 52 would be selected. The edge 46 of the support member 12 is set to the height. The support member 12 is leveled using the spirit level 66. Push pins 80 are inserted into the wall 52 through one tension pin hole 72 on each of the extended arms 14 (FIG. 12). The ceramic chair rail is laid along the edge 46 of the support member 12. To maintain the edge 46 at an attitude perpendicular to the wall 52 and flush against the wall 52, a set of shim tabs 94 (FIG. 13) are affixed to the bottom side of the support member 12 and placed into use during this type of installation. After the initial tiles 54 that cover the length of the support member 12 are set, the push pins 80 are removed. The support member 12 is moved along the wall 52 at the say height above the floor as the initial setting and again affixed to the wall 52 after leveling the support member 12 to continue the installation of the ceramic chair rail.

While the use of the invention in facilitating the installation of wall tile for the bathtub setting of FIG. 1, the facing fireplace wall setting of FIG. 9, and the chair rail installation of FIG. have been described with reference to specific embodiments or examples, variations in the use and configuration of the invention are possible and it is not intended to limit the invention except as defined in the following claims.

What is claimed is:

1. A device useful in the installation of fascia material to a wall tile, comprising:

a support member;

means for affixing the support member to a wall, the affixing means including means for expanding the support member length and means for biasing the expanded support member against side walls adjacent to the wall;

means for aligning the fascia material with the support member and in a predetermined relationship with the wall; and means for positioning the support member and centering a pattern of the fascia material on the wall.

2. The device recited in claim 1 further comprising:

the expanding means including a holding block that fits inside and in the center of the support member;

the biasing means including a compression spring affixed to the holding block and held in position by a dowel affixed to the holding block and located inside and in the center of the support member;

an arm biased against the compression spring and fitting inside and at the end of the support member; and a locking and release mechanism for he arm.

3. The device recited in claim 1 further comprising:

the expanding means includes an arm at each end of the support member and a holding block that fits inside and in the center of the support member;

the biasing means including a set of compression springs affixed to the holding block and held in position by a dowel affixed to the holding block and located inside and in the center of the support member, with the arms biased against the compression springs and fitting inside and at the ends of the support member; and locking and release mechanisms for the arms.

4. The device recited in claim 2 wherein the locking and release mechanisms further comprises:

a push pin; and a push pin spring embracing the push pin.

5. The device recited in claim 3 wherein the means for positioning and centering a pattern for the fascia material on the wall comprises:

a calibration scale on the arms;

means for adjusting the support member with the compression springs biased against the arms located on each end and inside of the support member.

6. The device recited in claim 5, further comprising an edge lip on the support member for resting the support member of an edge of the fascia material.

7. The device recited in claim 1 wherein the means for aligning the fascia material comprises a spirit level affixed to the support member.

8. The device for installing fascia material such as wall tile along a feature wall and adjacent side walls such as in bathtub and shower stalls and for comprising:

a support member having:

an edge on the support member for establishing a spacing between fascia material components on the feature wall;

means for extending end portions of the support member into engagement with the adjacent side walls; and means for positioning the support member and centering the fascia material pattern on the feature wall;

a side bar member attached to the support member;

means for aligning the support and side bar members respectively against the feature wall and one of the side walls; and means for installing the side bar member on a spigot wall.

9. The device recited in claim 8 further comprising:

each end portion including an arm extending inside the support member;

means including a block and compression springs within the support member for biasing the arms against the side walls;

a set of pins on the outside ends of each arm; and a locking and release mechanism for each of the arms.

10. The device recited in claim 9 wherein the means for centering the fascia material pattern on the wall comprises:

a matching calibration scale on each arm located on each end of the support member;

means for adjusting the support member to a preferred arm calibration scale mark; and means for locking the support member into the preferred position.

11. The device recited in claim 10 wherein the means for locking the support member into the preferred position includes a set pin and means for pushing the set pin through the support member and into the feature wall.

12. The device recited in claim 8 wherein the side bar member is attached to the support member by means of wire pins.

13. The device recited in claim 8 wherein the means for aligning the side bar member comprises a spirit level affixed to the side bar member.

14. The device recited in claim 12 further comprising:

the wire pins affixed to an end of the side bar member; and a set pin for affixing the side bar member to the wall.

15. The device recited in claim 8 wherein the side bar is shaped to allow the installation of fascia material without interference by a spigot pipe.

16. The device for installing fascia material on a facing fireplace wall comprising:

a first support member having means for affixing the first support member to a fireplace box;

a second support member affixed to the first support member;

means for leveling the second support member used in aligning the fascia material; and means for locating the second support member and centering a pattern of the fascia material on the facing fireplace wall.

17. The device recited in claim 16 wherein the means for affixing the first support member to the fireplace box comprises a means for expanding the support member to the width of the fireplace box.

18. The device recited in claim 17 further comprising:

a pair of arms, each extending from an end of said support member; and a locking and release mechanism int he support member for each arm.

19. The device recited in claim 16 wherein second support member comprises:

means for affixing the second support member to the first support member;

a calibration scale located on the second support member for centering the second support member on the fireplace box; and a spirit level affixed to the second support member.

20. A device for facilitating the setting of tile, brick or a similar facing material on a wall having side surfaces adjacent and on opposite sides of the wall, comprising:

an elongated support member with opposing ends and an upper supporting surface, the support member having a lengthwise dimension less than the width of the wall upon which the facing material is to be set;

a pair of arms, each arm fitted at an end of the support member and means for holding each arm in a retracted position with the corresponding end and selectively biasing each arm to an extended position into engagement with an adjacent side surface.

21. The device cited in claim 20 wherein the releasing means for each arm comprises:

a pair of compression springs in the support member, each positioned to bias a corresponding one of the arms longitudinally outwardly relative to the support member;

means for retaining each arm in the retracted position against the compression of the corresponding spring; and a push button in each arm and protruding into a corresponding hole in the support member for releasing the retaining means and permitting the corresponding arm to move to the extended position.

22. The device recited in claim 20 further comprising leveling means fixed to the support member.

23. A device useful int he installation on a wall of fascia material such as wall tile, brick, or a similar facing material comprising:

an elongated support member with opposing ends and an upper supporting surface, the support member having:

an edge on the support member for establishing a spacing between fascia material components such as wall tile grouting rows;

a pair of arms, each arm comprising:

a corresponding calibration scale;

a dimension to fit inside the support member;

a grooved slot in the arm;

a stop affixed to the support member sliding inside the grooved slot;

pin protruding from the end of the arm; and a holding block located inside the support member;

a pair of compression springs, each positioned to bias against the holding block and a corresponding one of the arms longitudinally outward relative to the support member;

a dowel passing through and affixed to the holding block and centered within the corresponding compression springs;

a push button mechanism located along the support member for locking the arms in a retracted position and extended position, which push button mechanism comprises:

a push button;

a push pin affixed to the push button; and a push pin spring biasing the push pin against the push button;

a spirit level affixed to the support member; and a pair of side bar members attaching to the support member comprising:

wire pins located at an end of the side bar member for attaching to the support bar;

holes along the side bar member set pins for affixing the side bar member to the wall; and a spirit level affixed to the side bar member; and a space cut out of the center top of the side bar

24. The device recited in claim 23 further comprising a second support member affixed to the support member having:

a spirit level affixed to the second support member; and a pair of calibration scales located toward the ends of the second support member.

25. A method for enabling a tile setter to align and center fascia material such as wall tile without assistance using inexpensive long setting cements comprising the following steps:

providing a tile supporting device with a support member;

affixing the tile supporting device on a wall by using arms attached and inside the support member;

centering the tile supporting device by using a calibration on the arms located inside the support member;

aligning the support member by using spirit levels affixed to the support member; and affixing the support member to the wall through the biasing of the extended arms and by using push pins.

26. The method recited in claim 25 further comprising the step of attaching side bar members for installing tile in bathtub and shower stalls.

27. The method recited in claim 25 further comprising a second support member for installing tile on facing fireplace walls.

* * * * *